US005609492A

United States Patent [19]

Sato et al.

[11] Patent Number: 5,609,492

[45] Date of Patent: Mar. 11, 1997

[54] ELECTRICAL CONNECTOR HAVING LINKAGE CONNECTING CAP WITH CONNECTOR HOUSING

[75] Inventors: Kazuomi Sato; Toshihiro Kume; Yoshiaki Ichimura; Takuya Takahashi, all of Tokyo, Japan

[73] Assignee: Japan Aviation Electronics Industry, Limited, Tokyo, Japan

[21] Appl. No.: 547,149

[22] Filed: Oct. 24, 1995

[30] Foreign Application Priority Data

Oct. 25, 1994 [JP] Japan ..... 6-259934
Jul. 24, 1995 [JP] Japan ..... 7-187428

[51] Int. Cl.[6] ..... H01R 13/44

[52] U.S. Cl. ..... 439/136; 439/142; 220/3.8; 220/259

[58] Field of Search ..... 439/136, 142; 220/255, 259, 247, 252, 3.8

[56] References Cited

U.S. PATENT DOCUMENTS

| | | | |
|---|---|---|---|
| 1,804,908 | 5/1931 | Wichert | 439/142 |
| 4,037,907 | 7/1977 | Klimek et al. | 439/142 |
| 4,342,493 | 8/1982 | Grenell | 439/142 |
| 5,228,584 | 7/1993 | Williams, Jr. | 220/3.8 |
| 5,501,607 | 3/1996 | Yoshioka et al. | 439/142 |

*Primary Examiner*—Gary F. Paumen
*Assistant Examiner*—Daniel Wittels
*Attorney, Agent, or Firm*—Laff, Whitesel, Conte & Saret, Ltd.

[57] ABSTRACT

An electrical connector having a cap rotatable by a link mechanism, there are a connector housing, a first link having a symmetrical structure of both sides of the connector housing and pivoted at the connector housing, a second link having a symmetrical structure of both sides of the connector housing and pivoted at the first link, a cap pivoted at the second link, a sealing member installed at circumference of the cap or a connector on the connector housing, and wherein at least one of the first link and the second link is made of a one piece member. The cap is fitted to a top of the connector housing, and covers the connector to lead into a waterproof state. When an operator pushes up a handle of the second link by his finger, the first link and the second link rotate. Then the cap takes off from the top of the connector housing, and so the connector is ready for electrical connection. Further, when the operator pushes down the handle of the second link by his finger, the first link and the second link rotate more. The cap fits to a bottom of the connector housing finally.

6 Claims, 10 Drawing Sheets

ELECTRICAL CONNECTOR HAVING LINKAGE CONNECTING CAP WITH CONNECTOR HOUSING

BACKGROUND OF THE INVENTION

This invention relates to an electrical connector having a cap for removably closing an opening of a connector housing and, in particular, to such an electrical connector having a connection of the cap to the connector housing.

An electrical connector such as a water-proof type comprises a connector housing having connecting components therein and an opening for connecting with a mating connector therethrough and a cap for closing the opening when the connector is not used.

In a conventional electrical connector of the type described, the connector housing and the cap are completely separate each other, or the cap is tied to the connector housing with string.

It should, however, be noted that the conventional electrical connector has a defective structure. Because the cap is often lost or an obstacle, when the cap is taken off from the connector housing. This renders the conventional electrical connector unreliable, difficult in treatment, and insufficient in sealing between the connector housing and the cap.

SUMMARY OF THE INVENTION

It is consequently an object of this invention to provide an electrical connector having a simple connection mechanism between a connector housing and a cap for enabling the cap opening and closing by operation of the mechanism.

It is still another object to provide the electrical connector where sealing is established between the connector housing and the cap, in addition to the above-described object.

Other objects of this invention will become clear as the description proceeds.

According to this invention, there is provided an electrical connector comprising a connector housing with an opening for connecting a mating connector therethrough and a cap for closing the opening, which comprises a pair of first links pivotally mounted onto an outer surface of the connector housing at opposite positions by a pair of first pivotal connections, respectively, the first pivotal connections coexisting on a line parallel with a plane of the opening, and a pair of second links pivotally connected to the first links by a pair of second pivotal connections, respectively, the second pivotal connections being a first distance from the first pivotal connections along the first links, the second links being pivotally connected to an outer side surface of the cap at opposite positions thereof by a pair of third pivotal connections, respectively, the third pivotal connections being a second distance from the second pivotal connections along the second links, the second distance being larger than the first distance, the first distance and the second distance being determined so that the cap comes into a tight contact with an edge of the opening of the connector housing when the first pivotal connections is brought onto the second distance between the second pivotal connections and the third pivotal connections by rotation of the first links around the first pivotal connections, while the cap can be rotated on the first pivotal connections around the connector housing at a state where the second pivotal connections are maintained on a distance between the first pivotal connections and the third pivotal connections after rotation of the second pivotal connections around the first pivotal connections.

The electrical connector may further comprise elastic sealing means for providing a sealed condition between the connector housing and the cap when the cap closes the opening of the connector housing, and a pair of stopper means for restricting rotation of the first links about the first pivotal connection when the second pivotal connections rotate around the first pivotal connections in a predetermined direction to bring the cap to close the opening and pass remote positions where the second pivotal connections are remote from the opening at the maximum, whereby the sealed condition is maintained when the first links are restricted from rotating in the predetermined direction, while elasticity of the elastic sealing means causes a force for rotating the first links through the second pivotal connections in the predetermined direction around the first pivotal connections.

In the electrical connector, the stopper means may be provided on the second links.

In the electrical connector, the stopper means may be provided on the outer surface of the connector housing.

In the electrical connector, at least one pair of the pair of first links and the pair of second links may have a connecting arm which joins paired links to each other to form a one piece member, the connecting arm having a shape and dimension so that the connecting arm can rotate around the connector housing together with the cap rotation around the connector housing on the first pivotal connections.

The electrical connector may further comprise guide means fixedly mounted on the outer surface of the connector housing, the connecting arm having guide grooves engaging with the guide means so that the connecting arm is guided for opening and closing operation of the cap.

DESCRIPTION OF THE PREFERRED EMBODIMENT

Referring now to FIGS. 1 to 7, the description will proceed to an electrical connector having a cap rotatable by a link mechanism according to a preferred first embodiment of this invention.

Figure 1:
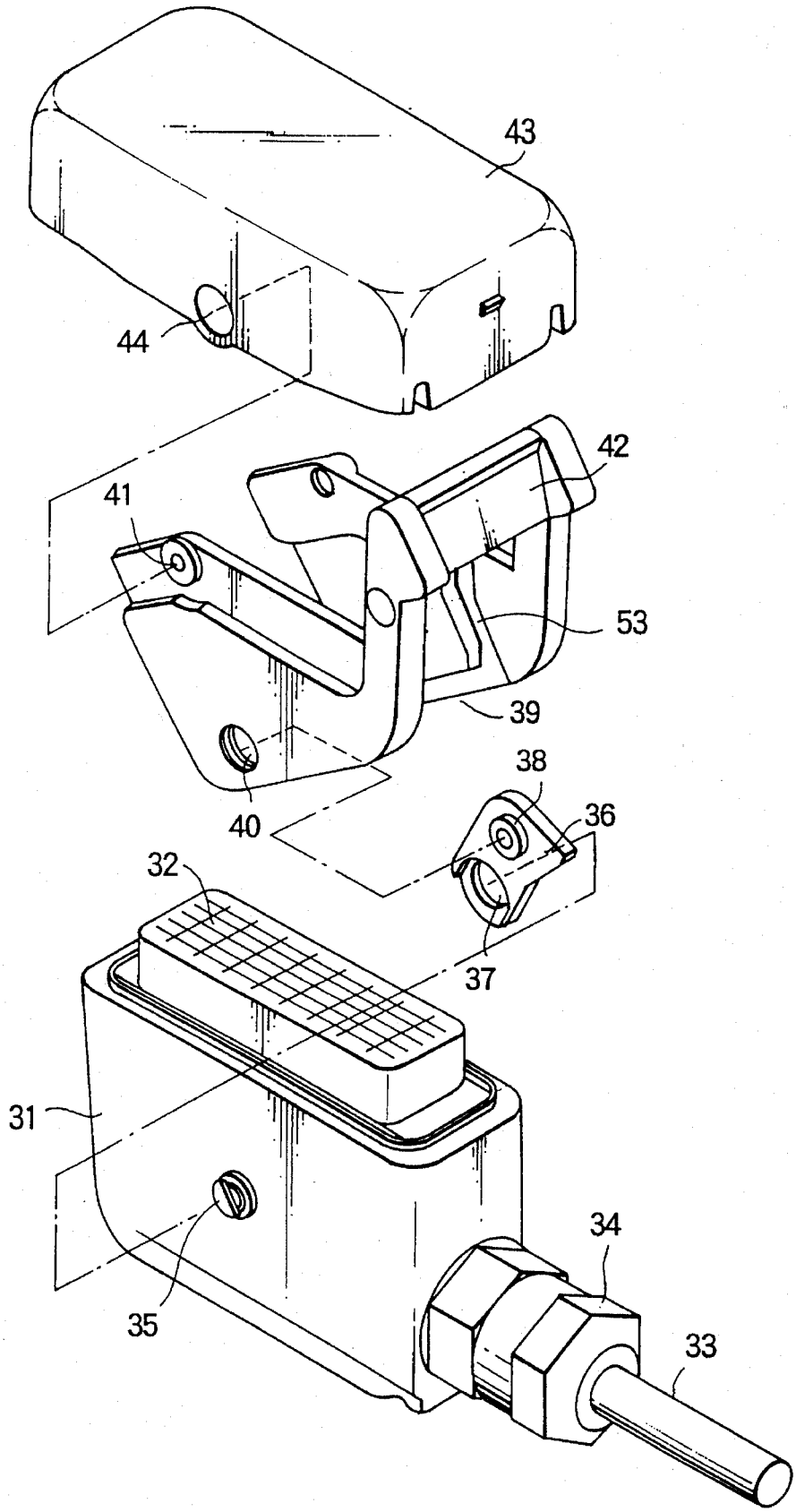
FIG. 1 is an exploded perspective view of an electrical connector having a cap according to a first embodiment of this invention.
Figure 2:
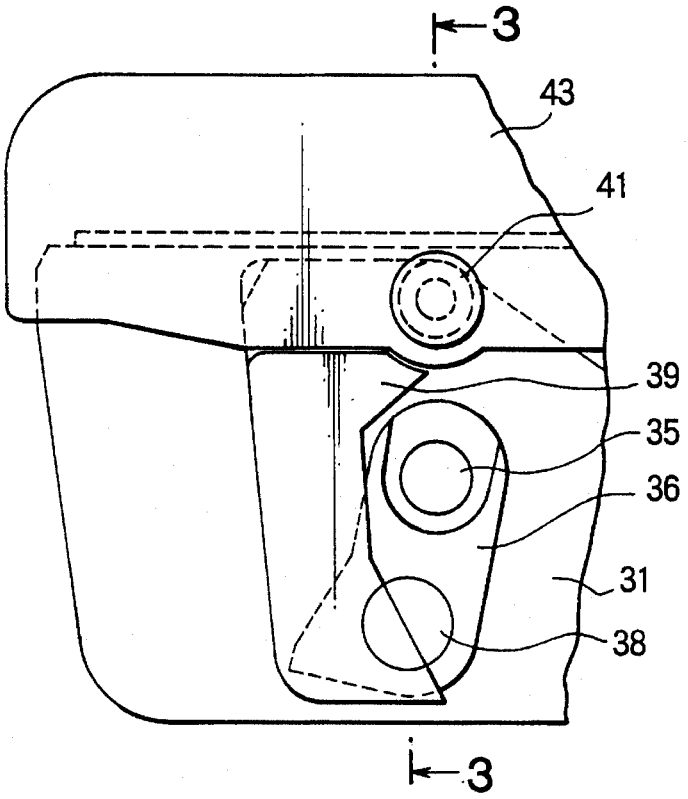
FIG. 2 is a partial front view of the electrical connector of FIG. 1.
Figure 3:
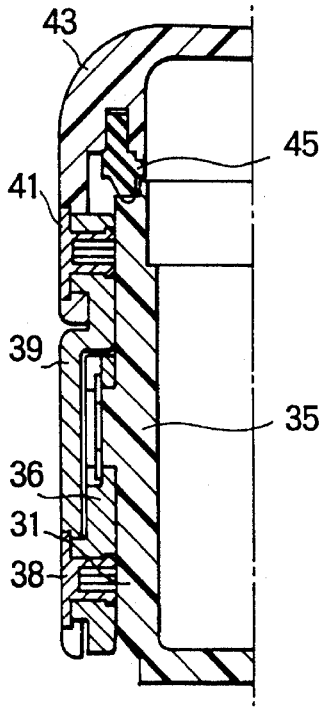
FIG. 3 is a sectional view illustrative of the electrical connector of FIG. 1, taken along a line A—A in FIG. 2.

In FIG. 1, a connector 32 is installed on a top of a connector housing 31. A cable 33 is fixed at a right side of the connector housing 31 by a waterproof clamp 34, and a pair of shafts 35 is fixed at a front center and a rear center of the connector housing 31. A pair of first links 36 has a hole 37 and a shaft 38, respectively. Each hole 37 fits to each shaft 35. A second link 39 which is made of a one piece member has a pair of holes 40, a pair of shafts 41, and a connecting arm or handle 42 joining the link portions to each other to form a one piece link 39. Each hole 40 fits to each shaft 38. A cap 43 has a pair of holes 44 at a front side and a rear side thereof. Each hole 44 fits to each shaft 41.

A looped sealing member 45 is installed in an inside of the cap 43, and the looped sealing member 45 can come into contact with periphery of the connector 32.

That is, a pair of first links 36 are pivotally mounted onto the outer surface of the connector housing 31 at opposite positions by a pair of first pivotal connections 35, respectively. The first pivotal connections 35 coexist on a line parallel with a plane of an opening of the connector housing.

A pair of second link portions joined by the handle pivotally connected to the first links 36 by a pair of second pivotal connections 38, respectively. The second pivotal connections 38 are a first distance from the first pivotal connections 35 along the first links 36. The second link portions are pivotally connected to an outer side surface of the cap 43 at opposite positions thereof by a pair of third pivotal connections 41, respectively. The third pivotal connections are a second distance from the second pivotal connections 41 along the second link portions. The second distance is larger than the first distance. The first distance and the second distance are determined so that the cap 43 comes into a tight contact with an edge of the opening of the connector housing 31 when the first pivotal connections 35 are brought onto the second distance between the second pivotal connections 38 and the third pivotal connections 41 by rotation of the first links 36 around the first pivotal connections 35, while the cap 43 can be rotated on the first pivotal connections 35 around the connector housing 31 at a state where the second pivotal connections 38 are on a distance between the first pivotal connections 35 and the third pivotal connections 41 after rotation of the second pivotal connections 38 around the first pivotal connections 35.

The above-mentioned looped sealing member 45 can be fixed at the periphery of the connector 32 installed on the top of the connector housing 31 by adoption of a designed modification.

The above-mentioned electrical connector has a symmetrical structure of the front side and the rear side thereof.

Referring now to FIGS. 4, 5, 6, and 7, the description will proceed to motion of the first embodiment of this invention.

Figure 4:
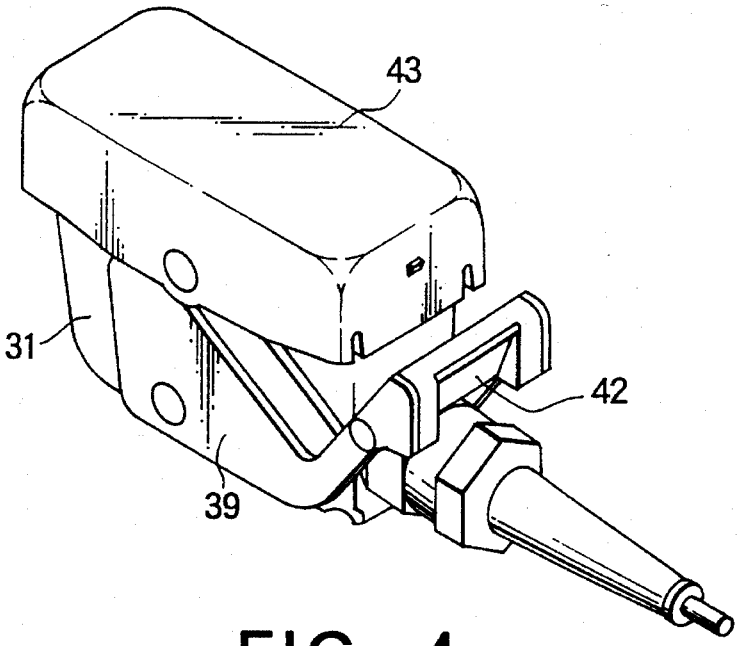
FIG. 4 is a perspective view of the electrical connector of FIG. 1, with the cap closing the connector for waterproof.

FIG. 4 shows a closed state or waterproof state of the first embodiment of this invention. The cap 43 is fitted to the top of the connector housing 31, and covers the connector 32.

Figure 5:
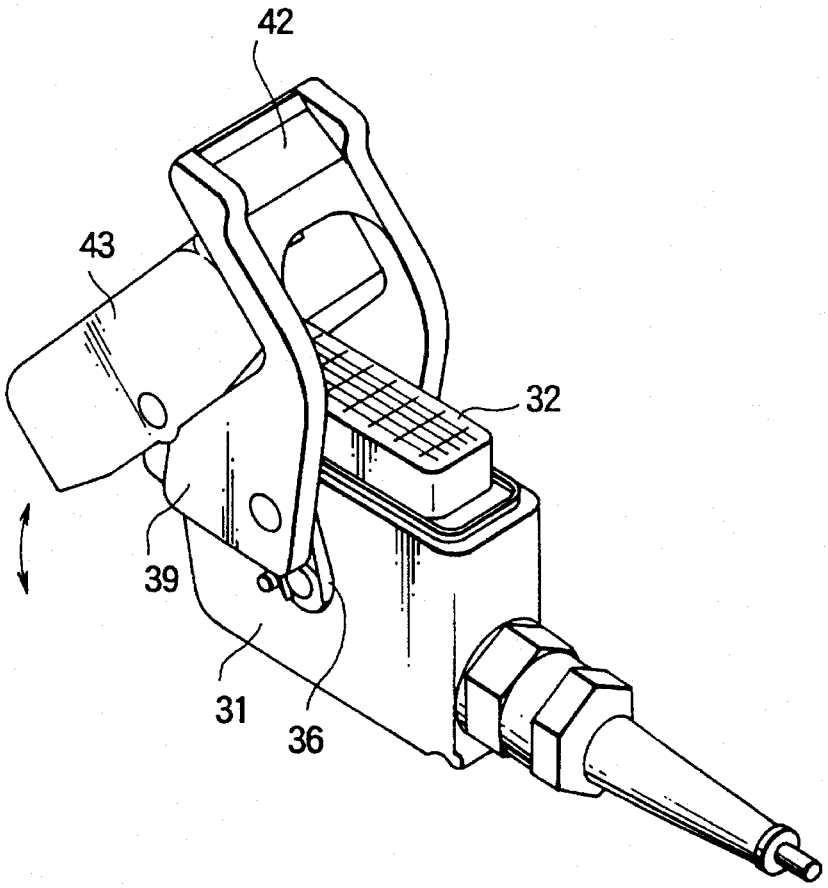
FIG. 5 is a perspective view of the electrical connector of FIG. 1 having the cap being rotatable around the connector by a link mechanism.

FIG. 5 shows a rotating state of the cap 43 for preparation of electrical connection. When an operator pushes up the handle 42 of the second link 39 by his finger in FIG. 4, a pair of first links 36 and the second link 39 rotate. Then the cap 43 takes off from the top of the connector housing 31.

Figure 6:
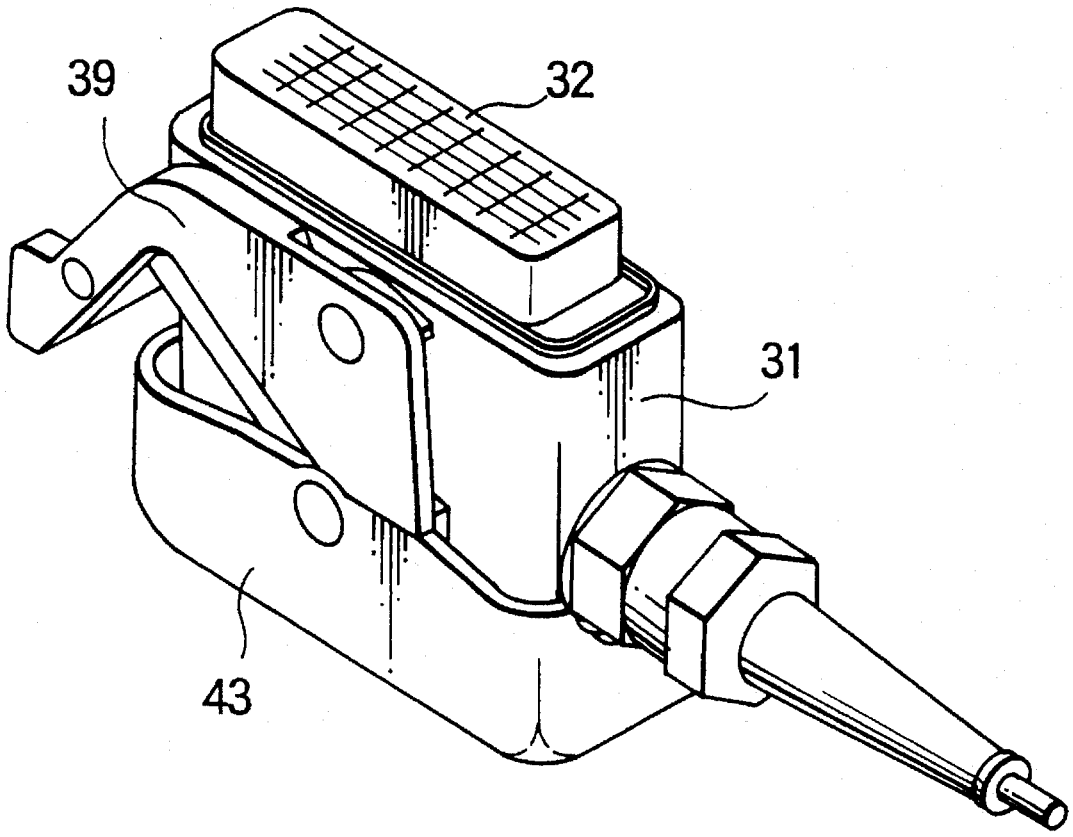
FIG. 6 is a perspective view of the electrical connector with the cap being moved to the bottom of the connector.

FIG. 6 shows a possible state of electrical connection. When the operator pushes down the handle 42 of the second link 39 by his finger in FIG. 5, the first link 36 and the second link 39 rotate more. The cap 43 fits to a bottom of the connector housing 31 finally.

Figure 7:
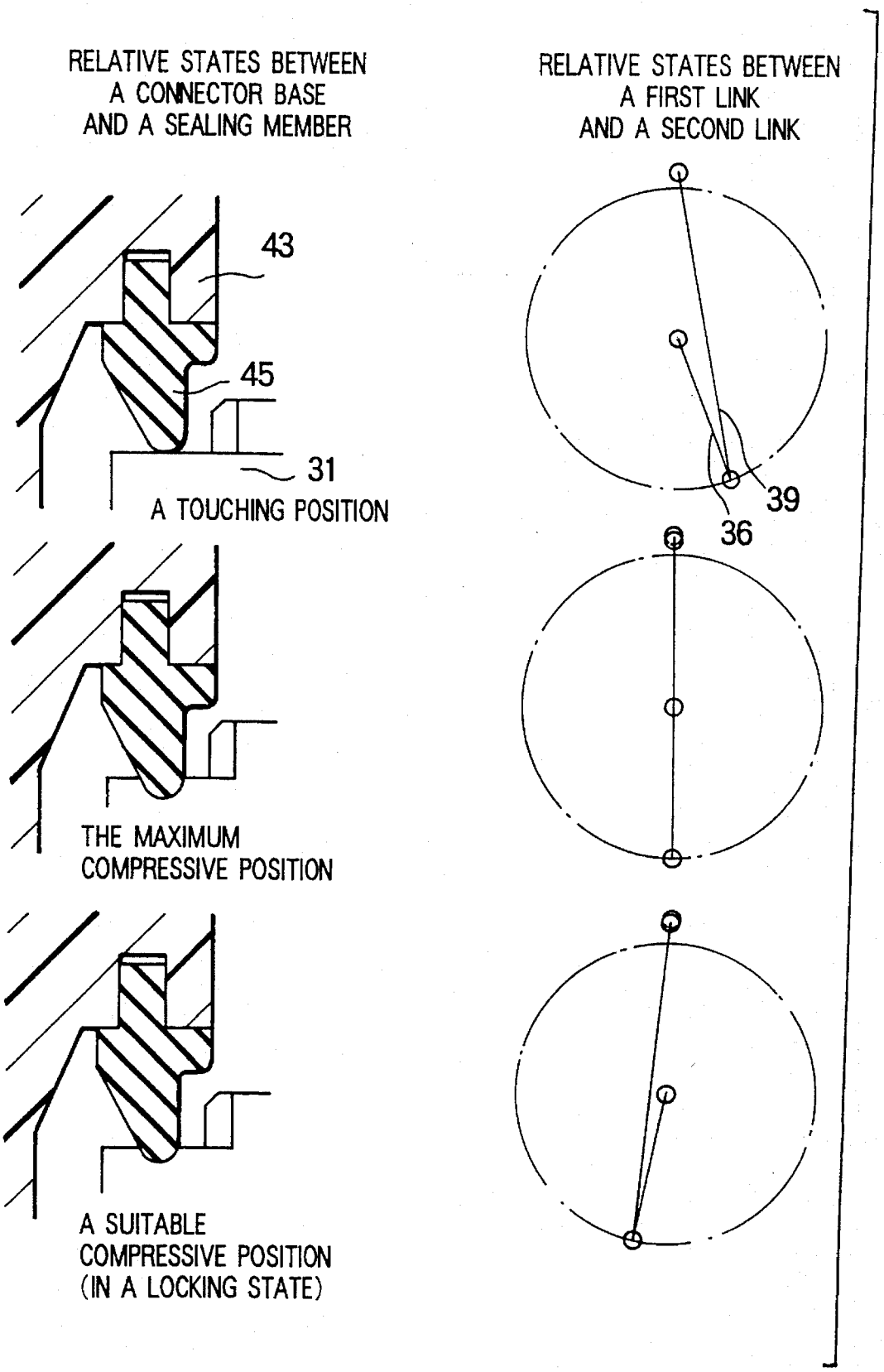
FIG. 7 shows relative states of a connector housing, a sealing member, a first link, and a second link of the electrical connector of FIG. 1, as the cap rotates by the link mechanism around the connector.
Figure 8:
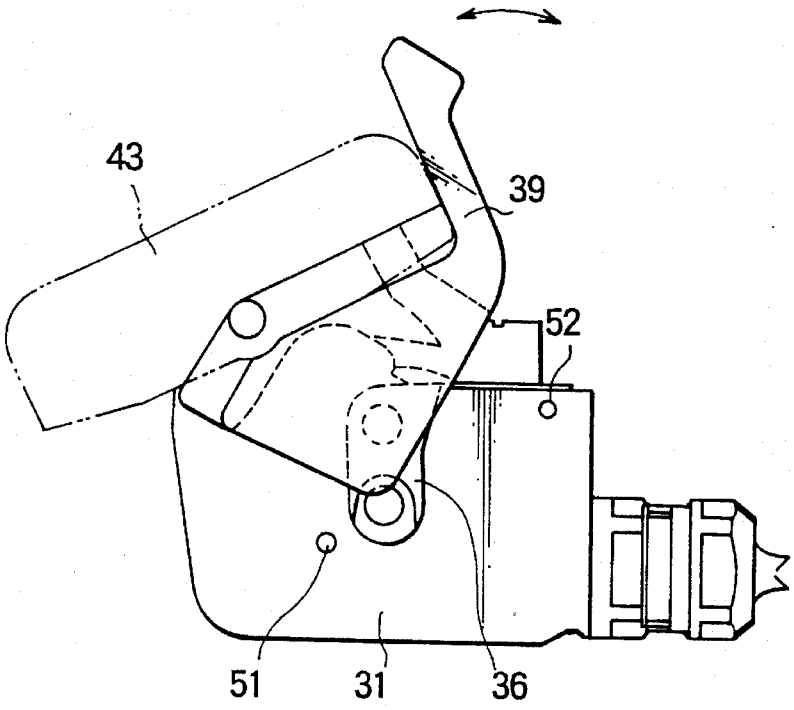
FIG. 8 is a front view of an electrical connector having a cap according to a second embodiment of this invention with the cap being rotated.
Figure 9:
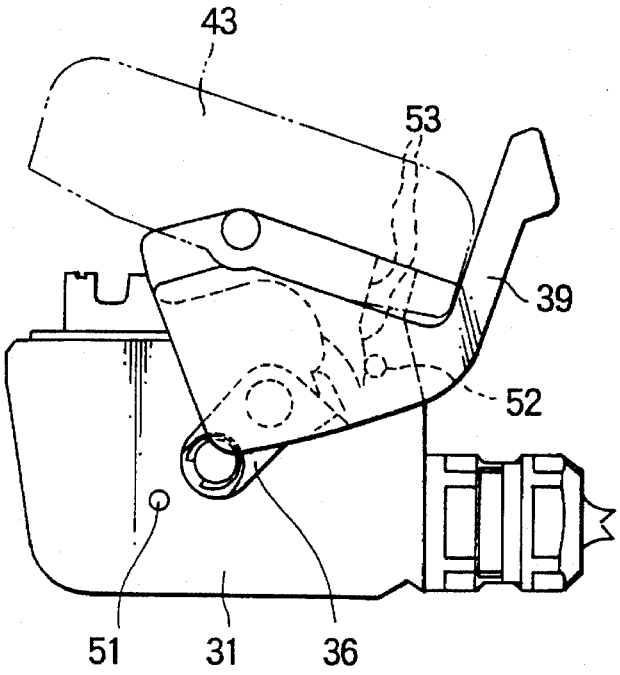
FIG. 9 is a front view of the electrical connector of FIG. 8 with the cap being just before closing condition.

FIG. 7 shows a positional relation between the sealing member 45 and the connector housing 31, and between the first link 36 and the second link 39. When the first link 36 and the second link 39 are rotated to lead into a position on the same straight line, the looped sealing member 45 gets to the maximum compressive position (approximately 0.7 mm). When the first link 36 and the second link 39 are further rotated to lead into a locking position, the looped sealing member 45 gets to a suitable compressive position (approximately 0.5 mm).

In the first embodiment of this invention, the first link 36 is a pair of the same members, the second link 39 is a one piece member as shown in FIG. 1. The first link 36 can be a one piece member, and the second link 39 can be a pair of the same members by adoption of a designed modification. Both the first link 36 and the second link 39 can be a one piece member respectively by adoption of a different designed modification.

In case of adoption of the above-mentioned designed modifications, when the cap 43 fits to the bottom of the the connector housing 31, the connecting portion of a pair of the first links 36 must not obstruct rotation of a pair of the first links 36. Consequently the cable 33 and the waterproof clamp 34 installed at the side of the connector housing 31 must be converted to a suitable position of the front or the rear of the connector housing 31.

Referring now to FIGS. 8, 9, 10, and 11, the description will proceed to an electrical connector having a cap rotatable by a link mechanism according to a preferred second embodiment of this invention. Corresponding descriptions have been done to identical parts in the first embodiment of this invention and need not be further described.

The front and the rear of the connector housing 31 have a first positioning pin or a stopper 51 for regulating of rotation of the first link 36, and a second positioning pin or a guide pin 52 for regulating of rotation of the second link 39 respectively. The second positioning pin 52 and a groove 53 installed at an inside of the second link 39 guide the cap 43 from a state in FIG. 8 to a state in FIG. 9. The second link 39 makes the looped sealing member 45 to the top of the connector housing 31 touch at a suitable position in order to seal surely. The second positioning pin 52 has functions of prevention from reverse rotation of the cap 43, the first link 36, and the second link 39.

That is, the stopper 52 restricts rotation of the first links 36 about the first pivotal connections 35 when the second pivotal connections 38 rotate around the first pivotal connections 35 in a predetermined direction to bring the cap 43 to close the opening and pass remote positions where the second pivotal connections 38 are remote from the opening at maximum, whereby the sealed condition is maintained when the first links 36 are restricted from rotating in the predetermined direction, while elasticity of the elastic sealing member 45 causes a force for rotating the first links 36 through the second pivotal connections 38 in the predetermined direction around the first pivotal connections 35.

The groove 53 installed at the inside of the second link 39 can be converted into a cam having one surface for guiding.

Figure 10:
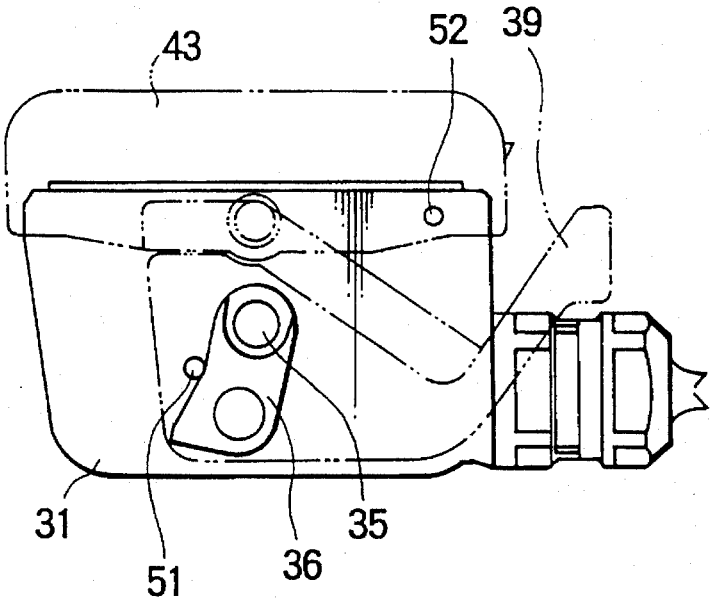
FIG. 10 is a front view of the electrical connector of FIG. 8 with the cap being closed.
Figure 11:
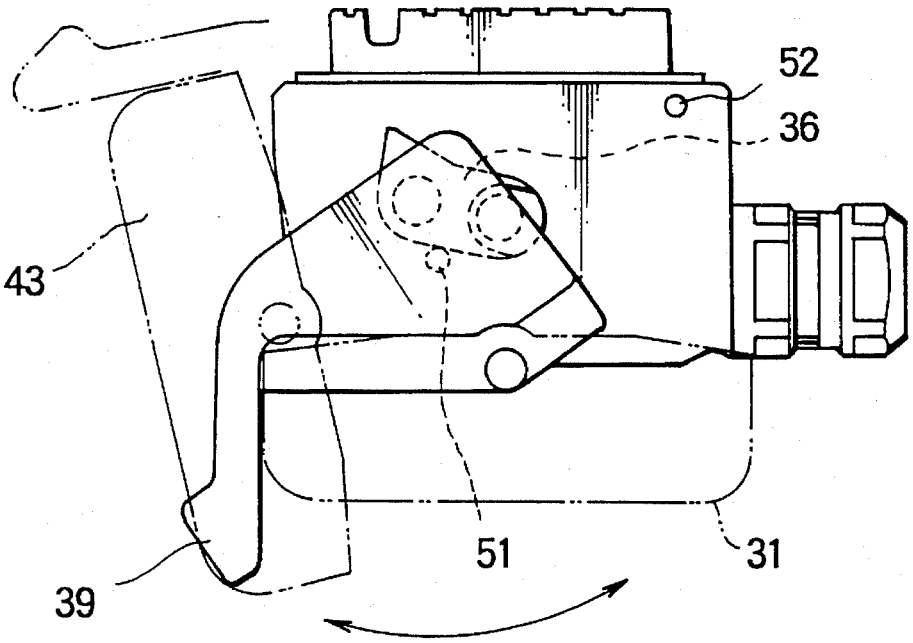
FIG. 11 is a front view of the electrical connector of FIG. 8 with the cap being opened and moved to the bottom of the connector.

In a waterproof state, a first surface of the first link 36 touches the first positioning pin 51, and so the first link 36 is positioned, as shown in FIG. 10. When the operator pushes up the second link 39, the first link 36 rotates counterclockwise around the shaft 35. Then, a second surface of the first link 36 touches the first positioning pin 51, and so the first link 36 is positioned, as shown in FIG. 11. During the above-mentioned motion of the first link 36, the second link 39 rotates around the shaft 38 of the first link 36. Then the cap 43 rotates around the shaft 41 of the second link 39, and gets to the bottom of the connector housing 31. Consequently the looped sealing member 45 installed at the cap 43 touches to the bottom of the connector housing 31, and so the cap 43 fits to the bottom of the connector housing 31 surely. The first positioning pin 51 has functions of prevention from reverse rotation of the cap 43, the first link 36, and the second link 39.

Referring now to FIGS. 12 to 17, the description will proceed to an electrical connector having a cap rotatable by a toggle link mechanism according to a preferred third embodiment of this invention. Corresponding descriptions have been done to identical parts in the first embodiment of this invention need not be further described.

Figure 14:
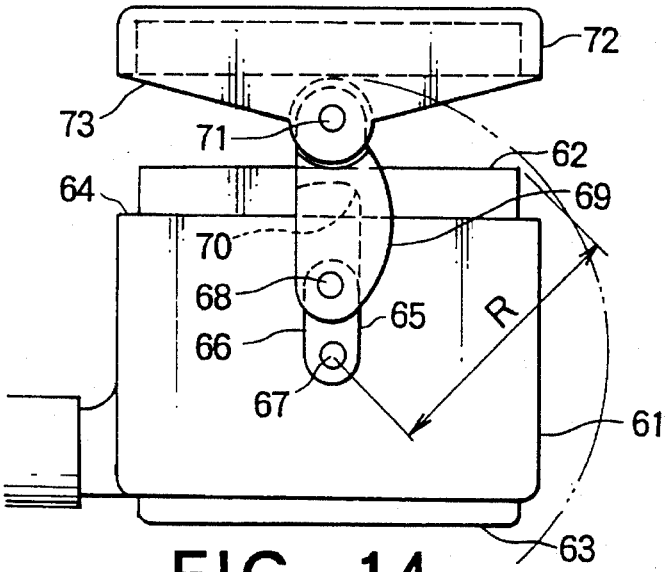
FIG. 14 is a front view of the electrical connector of FIG. 12, illustrating first links and second links extended at the maximum to form a straight line.

A connector (not shown) is installed on a top of a connector housing 61. A first link 61 is pivoted at a shaft 67 fixed to a front center of the connector housing 61. A second link 69 is pivoted at a shaft 68 fixed to the first link 65, and a cap 72 is pivoted at a shaft 71 fixed to the second link 69, as shown in FIG. 14. The connector housing 61 has a fitting portion 62 for the cap 72 at a top thereof, and an escaping portion 63 for the cap 72 at a bottom thereof. The connector housing 61 has a sealing surface 64 at the periphery of the fitting portion 62 for the cap 72. The cap 72 has a sealing surface 73 made of rubber plate at the periphery of a bottom thereof. The first link 65 has a circumferential portion 66, and the second link 69 has a concave wall 70.

The above-mentioned electrical connector has a symmetrical structure of a front side and a rear side thereof.

Referring now to FIGS. 12, 13, 14, 15, and 16, the description will proceed to motion of the third embodiment of this invention.

In FIG. 14, the first link 65 and the second link 69 are extended at maximum to form a straight line. The cap 72 is first rotated at the angle of 180 degrees clockwise around the shaft 67, and along an arc locus shown by a two dot-dash line. Because the radius of the arc locus is longer than half R of the diagonal length of the connector housing 61, the cap 72 can rotate without hindrance.

Figure 15:
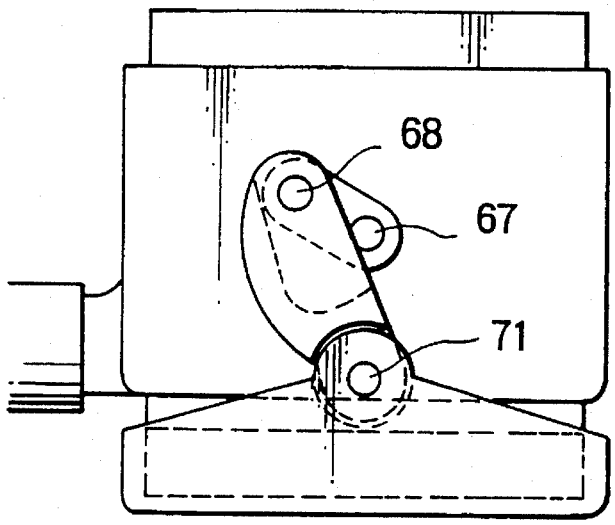
FIG. 15 is a front view of the electrical connector of FIG. 12 with the cap just before fitting to a bottom portion of the connector.
Figure 16:
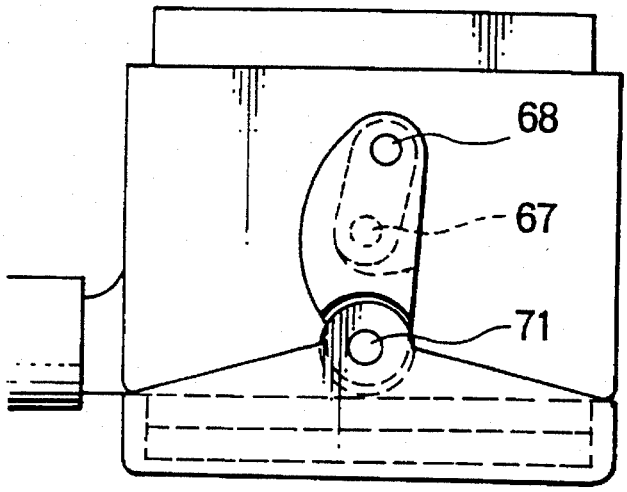
FIG. 16 is a front view of the electrical connector of FIG. 12 with the cap fitted to the bottom portion.
Figure 17:
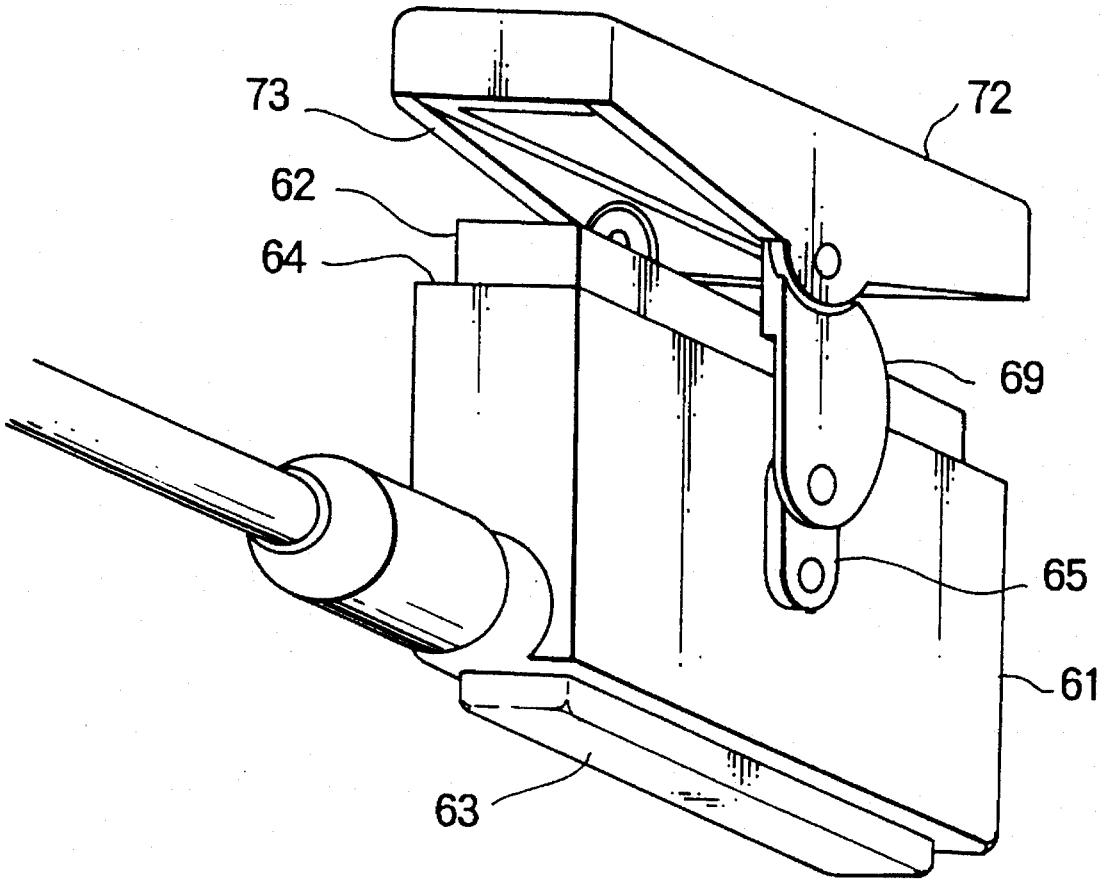
FIG. 17 is a perspective view of the electrical connector of FIG. 14.

Then the cap 72 is pushed up to a state of FIG. 16 after going through a state of FIG. 15. During the above-mentioned motion of the cap 72, the first link 65 and the second link 69 are folded, and so the cap 72 fits to the escaping portion 63 of the connector housing 61.

Figure 12:
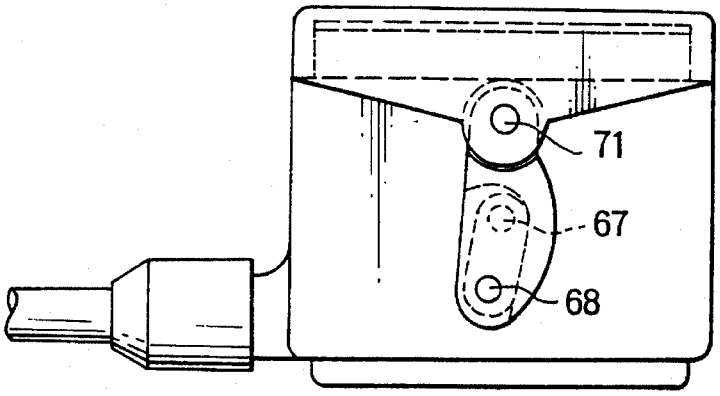
FIG. 12 is a front view of an electrical connector having a cap according to a third embodiment of this invention.
Figure 13:
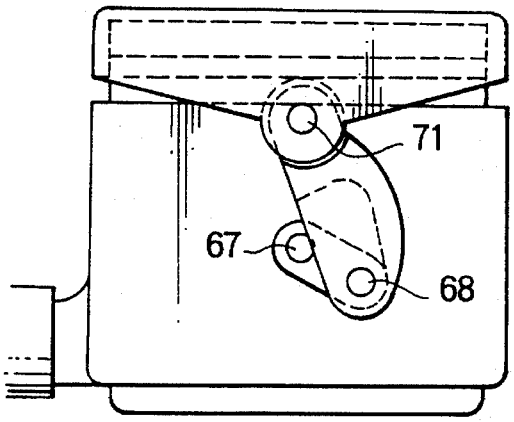
FIG. 13 is a front view of the electrical connector of FIG. 12, immediately after the cap starts to open.

In FIG. 14, when the first link 65 and the second link 69 have been folded, the cap 72 gets to a state of FIG. 12 after going through a state of FIG. 13. Then the cap 72 fits to the fitting portion 62 of the connector housing 61, and so the sealing surface 73 made of rubber plate of the the cap 72 is pressed to the sealing surface 64 of the connector housing 61.

When the shaft 68 is located on an extended line of a straight line connecting between the shaft 71 and the shaft 67 on the way from the state of FIG. 15 to the state of FIG. 12, the cap 72 approaches nearest to the connector housing 61, therefore the sealing surface 73 made of rubber plate of the cap 72 is pressed at most. The cap 72, the first link 65, and the second link 69 stop at a little too far position, as shown in FIG. 12. This reason is as follows. Because the shaft 68 is given an upward tension, the first link 65 intends to rotate clockwise around the shaft 67 by force of elastic restitution of the rubber plate for sealing. But the first link 65 and the second link 69 can not rotate any more, because the concave wall 70 of the second link 69 has run into the circumferential portion 66 of the first link 65.

The above-mentioned rubber plate of the cap 72 can be converted into the sealing surface 64 installed at the periphery of the fitting portion 62 of the connector housing 61 by adoption of a designed modification. Further, contrary to the third embodiment of this invention, the first link 65 can have a concave wall 70, and the second link 69 can have a circumferential portion 66. Furthermore, the first link 65 can have a pin instead of the circumferential portion 66 as a stopping means of relative rotation more than a predetermined limit of the second link 69 to the first link 65, and the second link 69 can have a pin instead of the concave wall 70 in the same way.

Thus this invention renders the electrical connector having the cap rotatable by the link mechanism more reliable. Further, this invention renders the whole structure of the electrical connector having the cap rotatable by the link mechanism more compact.

Furthermore, this invention renders the electrical connector having the cap rotatable by the toggle link mechanism more sufficient in sealing between the connector housing and the cap by weak force.

Moreover, this invention renders the electrical connector having the cap rotatable by link mechanism more easy in handling.

What is claimed is:

1. An electrical connector comprising a connector housing with an opening for connecting a mating connector therethrough and a cap for closing the opening, which comprises:

a pair of first links pivotally mounted onto an outer surface of said connector housing at opposite positions by a pair of first pivotal connections, respectively, said first pivotal connections coexisting on a line parallel with a plane of said opening; and a pair of second links pivotally connected to said first links by a pair of second pivotal connections, respectively, said second pivotal connections being a first distance from said first pivotal connections along said first links, said second links being pivotally connected to an outer side surface of said cap at opposite positions thereof by a pair of third pivotal connections, respectively, said third pivotal connections being a second distance from said second pivotal connections along said second links, said second distance being larger than said first distance, said first distance and said second distance being determined so that said cap comes into a tight contact with an edge of said opening of said connector housing when said first pivotal connections is brought onto said second distance between said second pivotal connections and said third pivotal connections by rotation of said first links around said first pivotal connections, while said cap can be rotated on said first pivotal connections around said connector housing at a state where said second pivotal connections are maintained on a distance between said first pivotal connections and said third pivotal connections around said first pivotal connections.

2. An electrical connector as claimed in claim 1, further comprising elastic sealing means for providing a sealed condition between said connector housing and said cap when said cap closes said opening of said connector housing, and a pair of stopper means for restricting rotation of said first links about said first pivotal connection when said second pivotal connections rotate around said first pivotal connections in a predetermined direction to bring said cap to close said opening and pass remote positions where said second pivotal connections are remote from said opening at the maximum, whereby said sealed condition is maintained when said first links are restricted from rotating in said predetermined direction, while elasticity of said elastic sealing means causes a force for rotating said first links through said second pivotal connections in said predetermined direction around said first pivotal connections.

3. An electrical connector as claimed in claim 2, wherein said stopper means are provided on said second links.

4. An electrical connector as claimed in claim 2, wherein said stopper means are provided on the outer surface of said connector housing.

5. An electrical connector as claimed in claim 1, wherein at least one pair of said pair of first links and said pair of second links has a connecting arm which joins paired links to each other to form a one piece member, said connecting arm having a shape and dimension so that said connecting arm can rotate around said connector housing together with said cap rotation around said connector housing on said first pivotal connections.

6. An electrical connector as claimed in claim 5, further comprising guide means fixedly mounted on the outer surface of said connector housing, said connecting arm having guide grooves engaging with said guide means so that said connecting arm is guided for opening and closing operation of said cap.

* * * * *